United States Patent [19]

Reis

[11] Patent Number: 4,841,282

[45] Date of Patent: Jun. 20, 1989

[54] SMOKE AND LIQUID ALARM

[76] Inventor: Gustave A. Reis, 5270 Daniels, Troy, Mich. 48098

[21] Appl. No.: 215,419

[22] Filed: Jul. 5, 1988

[51] Int. Cl.[4] ..... G08B 19/00; G08B 17/10

[52] U.S. Cl. ..... 340/521; 340/602; 340/612; 340/618; 340/628; 340/629

[58] Field of Search ..... 340/521, 596, 602–605, 340/612, 618, 620–625, 628, 629, 693; 417/36, 38, 40, 63; 116/107, 110, 214, 227, 228; 73/304 R, 307

[56] References Cited

U.S. PATENT DOCUMENTS 4,228,428 10/1980 Niedermeyer ..... 340/628

4,258,359 3/1981 McLamb ..... 340/628

4,369,438 1/1983 Wilhelmi ..... 340/623

*Primary Examiner*—Donnie L. Crosland

*Attorney, Agent, or Firm*—Krass & Young

[57] ABSTRACT

A smoke and liquid level detector particularly useful for detecting sump pump failure. The detector comprises a sensor head containing two exposed electrodes in electrical contact with two leads which are connected to either side of the ionization chamber of a conventional, ionization-type smoke detector. The sensor head is disposed immediately above the normal water level within the sump well of a sump pump. In case of sump pump failure, the rising water level will immerse the sensor head, causing the electrical contact to be made between the two electrodes, thereby completing a circuit and causing an alarm signal to be sounded.

9 Claims, 3 Drawing Sheets

SMOKE AND LIQUID ALARM

This invention relates to the field of liquid level detectors and, more particularly, to such a detector which utilizes the circuitry of an ionization type smoke alarm.

DESCRIPTION OF THE RELEVANT PRIOR ACT

Many homes, offices and commercial buildings are constructed in areas having a high water table. Often, buildings are constructed where there is water drainage into the foundation area of the structure. In order to prevent build up of water levels inside the structures, many of the buildings are supplied with sump pumps which are designed to pump away excess water accumulation and protect the building against water damage.

Conventionally, such sump pumps are mounted in a sump pump well which is depressed below the floor level of the building of the basement. The sump pump operates to pump water out of the sump well, thus preventing the water level from reaching the floor level of the basement.

Like any mechanical apparatus, such sump pumps are subject to occasional failure. This is particularly true when the sump pump is operating continuously during conditions of abnormally high water tables. If such a failure occurs, the building is subject to flooding.

Frequently, the first warning sign that a sump pump failure has occurred is a rising water level in the basement of the building. This flooding may not be noticed until considerable damage has already occurred. In any case, the building owner or manager is faced with the difficult task of preventing more water from entering the building, removing the water already there, and cleaning up. Clearly, some kind of warning indicator or alarm indicating failure of the sump pump would prevent many of these problems.

In view of the clear advantages of an early warning system for sump pump failure, it is not surprising that a number of such warning devices are known in the prior art. Such devices are disclosed in, for example, U.S. Pat. Nos.: 4,705,456; 4,369,438; 4,255,747; 4,187,503; 3,932,853; and 3,634,842. Typically, these prior art sump pump alarms include a float which is disposed in the sump well, circuitry for a warning alarm, and some kind of switch which is triggered when the float reaches a predetermined level to close the alarm circuitry and sound the alarm. Because of the complex mechanical nature of these devices, they have not come into widespread use, at least for sump pump systems used in residential buildings. Furthermore, such systems are electromechanical, prone to mechanical failure and not particularly responsive to slight changes in water level or the presence of a small amount of moisture. Hence, their level of sensitivity is not high.

Battery-operative ionization-type smoke detectors have gained a reputation as reliable, inexpensive, easily installed devices useful as an early warning system for the presence of smoke and fire in houses and other buildings. So successful has been their penetration into this market that the installation of such devices have been made mandatory by building codes in many areas. Ionization-type smoke alarms feature an ionization chamber having a source of radiation therein responsive to the presence of a predetermined level of ions within the chamber. Circuitry is operatively connected to the chamber which is responsive to a lowering of impedance therein and acts to sound an alarm signal in response to such lower impedance. In the presence of smoke or gas, a sufficient number of ions enter the chamber so as to lower the impedance therein and cause the alarm signal to be sounded.

By utilizing the circuitry of an ionization-type smoke alarm to detect a sudden increase in electrical conductivity and sound an alarm signal in response thereto, it has been unexpectedly found that such circuitry can be used to create a highly sensitive and reliable sump pump warning alarm. By connecting electrical leads to the circuitry on each side of the ionization chamber and connecting the other ends of the leads to electrodes, a conductive path between the pair of electrodes created by the presence of moisture or water will sound the warning alarm and indicate a sump pump failure in time to serve as an effective warning device.

SUMMARY OF THE INVENTION

Disclosed in claims herein is a detector which can be used to detect a rising liquid level, such as may be found in a sump well in cases of sump pump failure. The liquid level detector is used with a prior art smoke alarm of the ionization type having an ionization chamber which acts in response to the presence of a predetermined level of ions therein to lower the impedance thereof. Circuitry is operatively associated with the ionization chamber and causes sounding of an alarm signal in response to said lowered impedance. The liquid level detector comprises a sensor head having two spaced-apart electrodes each in electrical communication with an electrically conductive lead. The leads are connected to the circuitry on either side of the ionization chamber so that the electrodes are in parallel therewith. Liquid in contact with the electrodes establishes a conductive path therebetween to complete the alarm circuit and cause sounding of the alarm signal.

Preferably, the head of the liquid level detector further comprises a non-conductive covering comprised of a flexible, waterproof material such as a plastic. The covering encloses at least a portion of each electrode such that undesirable shorting or arcing therebetween is prevented. A small portion of each electrode remains uncovered by the insulating material to serve as the conductive path.

It is contemplated that one useful embodiment of the liquid level detector of the present invention is a sump pump alarm. In this embodiment, the head is disposed in a sump pump well at a predetermined level in close proximity to what is determined to be the optimum safe water level within the sump well. In this embodiment, it is contemplated that the leads will be mounted on a conventional discharge line of the sump pump. When the water level rises above the level predetermined to be safe, it will contact the exposed electrodes of the head and complete the conductive path to sound the warning alarm.

In prior art smoke alarms of the ionization type, the ionization chamber is typically contained within an electrically conductive housing. Such smoke alarms are provided with a test button which is connected to ground. Depression of the button causes sounding of the alarm signal, this serving as a test of whether the battery is still charged. It is contemplated that one lead of the liquid level detector of the present invention is put in electrical contact with the housing of the ionization chamber and the other lead is put in electrical contact with the test button. It is to be noted that since the liquid level detector is connected in parallel with both the ionization chamber and with the test button, operation of both of these features of a conventional smoke alarm are still operative. Hence, the functioning of the smoke alarm to detect the presence of smoke and gas remains unimpaired, as does the battery test function.

In another embodiment of the instant invention, a plurality of such liquid level detectors may be connected in parallel to in ionization-type smoke alarm in the manner disclosed above. The heads of the plurality of liquid level detectors may then be placed at a plurality of locations within, for example, the basement of a building. Hence, it becomes possible to detect the presence of undesirable high water levels at multiple locations within the structure.

BRIEF DESCRIPTION OF THE DRAWINGS

The foregoing and additional features and advantages of the instant invention will become more readily apparent from the following detailed description of a specific illustrative embodiment thereof, presented hereinbelow in conjunction with the accompanying drawings, in which.

DETAILED DESCRIPTION OF THE PREFERRED EMBODIMENTS

Figure 1:
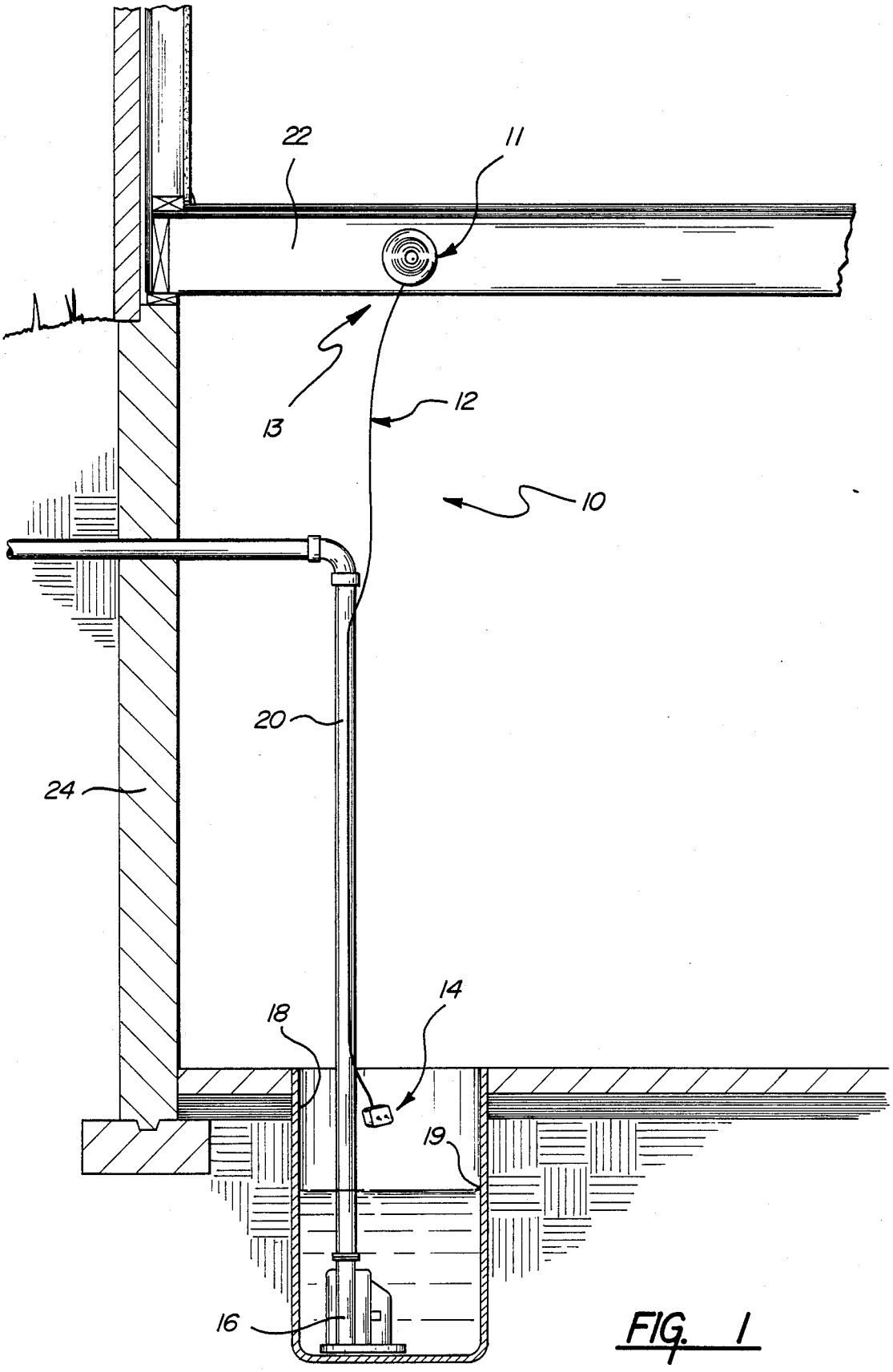
FIG. 1 is a schematic view showing the smoke and liquid level detector of the present invention used as a sump pump alarm.

Throughout the following detailed description, like reference numerals are used to refer to the same element shown in multiple figures thereof.

Figure 2:
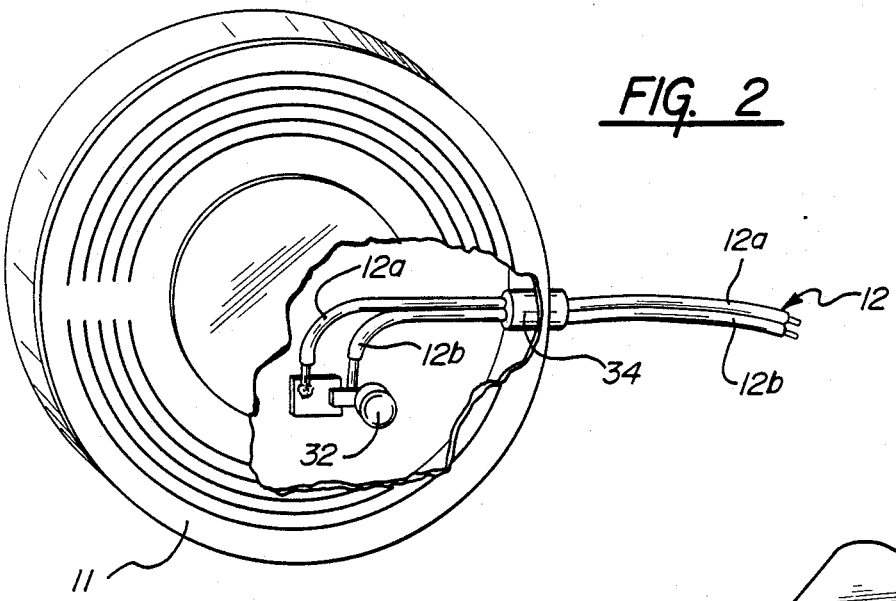
FIG. 2 illustrates one mode of connecting the sensor head of the smoke and liquid level detector of the instant invention to a conventional ionization-type smoke alarm.
Figure 3:
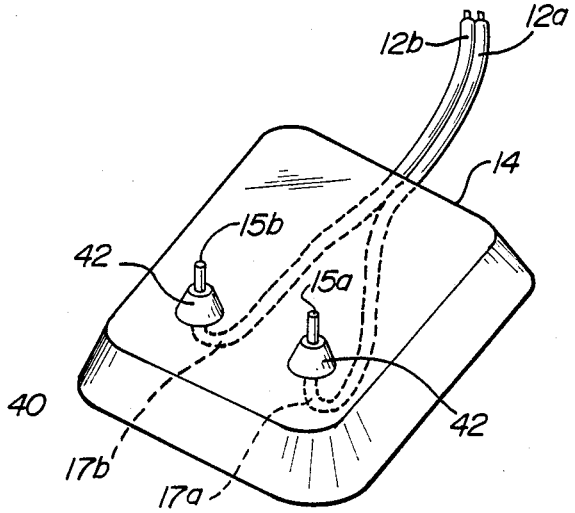
FIG. 3 is a detail view of the sensor head shown in FIG. 1 with certain components thereof shown in phantom.

Referring now to the drawing and in particular to FIGS. 1, 2 and 3, there is shown a combined smoke and liquid detector 10 of the instant invention. The smoke and liquid detector 10 includes in combination a conventional ionization-type smoke alarm 11 and a liquid level detector 13. Liquid level detector 13, in turn, is comprised of sensor head 14 which is connected to smoke alarm 11 by line 12. Line 12, as can be seen in FIGS. 2 and 3, is comprised of two leads 12*a*, 12*b*. In the embodiment shown in FIG. 2, lead 12*a* is shown in electrical contact with a housing 30 of smoke detector 11 which serves as a ground. Lead 12*b* is in electrical contact with test button 32 of smoke alarm 11. Leads 12*a*,12*b* terminate in, respectively, exposed electrodes 15*a*,15*b*, as can be seen in FIG. 3. Sensor head 14 further comprises an insulating jacket 40 which has two projections 42 formed thereon. It is contemplated that exposed electrodes 15*a*,15*b* will each extend from a projection 42. In this manner, accidental contact of leads 12*a*,12*b* with a conductive material such as water will be prevented. Only the projecting electrodes 15*a*,15*b* may make contact with the conductive substance. In the embodiment shown in FIG. 3*a*, each lead 15*a*, 15*b* is bent at approximate right angles to form a projecting portion 17*a*,17*b* respectively which terminates in exposed electrodes 15*a*, 15*b* respectively.

Figure 4A:
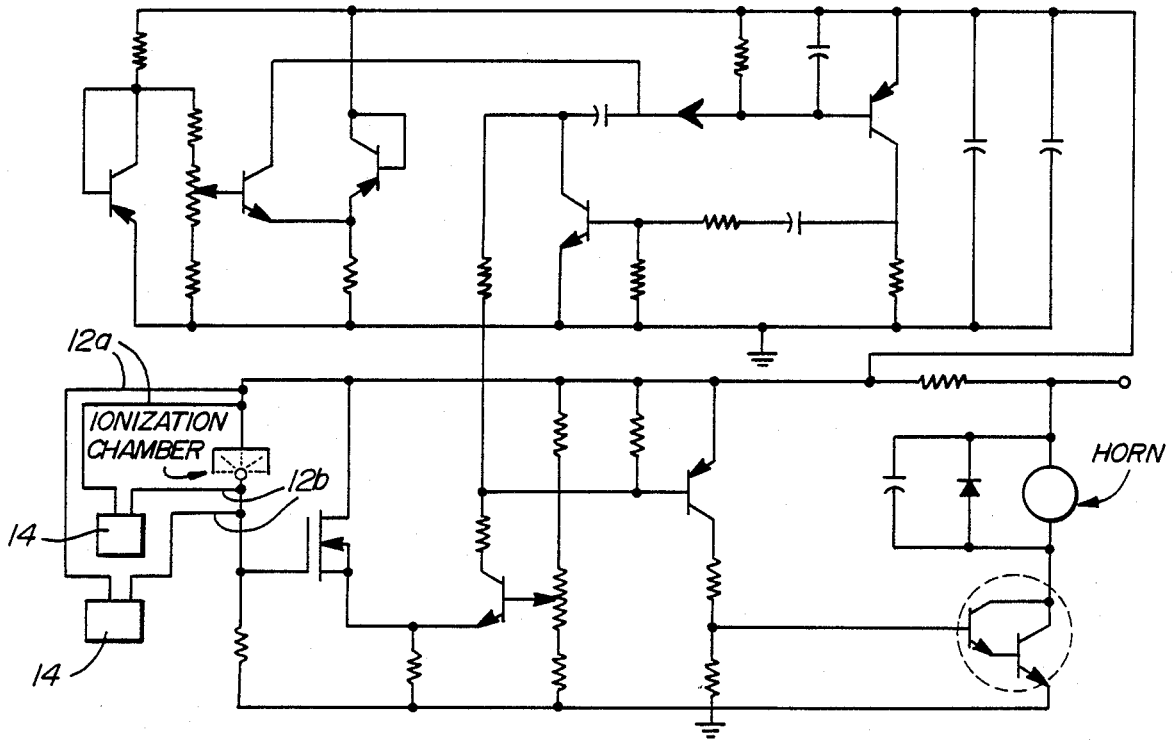
FIGS. 4*a*, 4*b* and 4*c* are circuit diagrams of various types of ionization smoke alarms suitable for use with the liquid level detector of the instant invention.
Figure 4B:
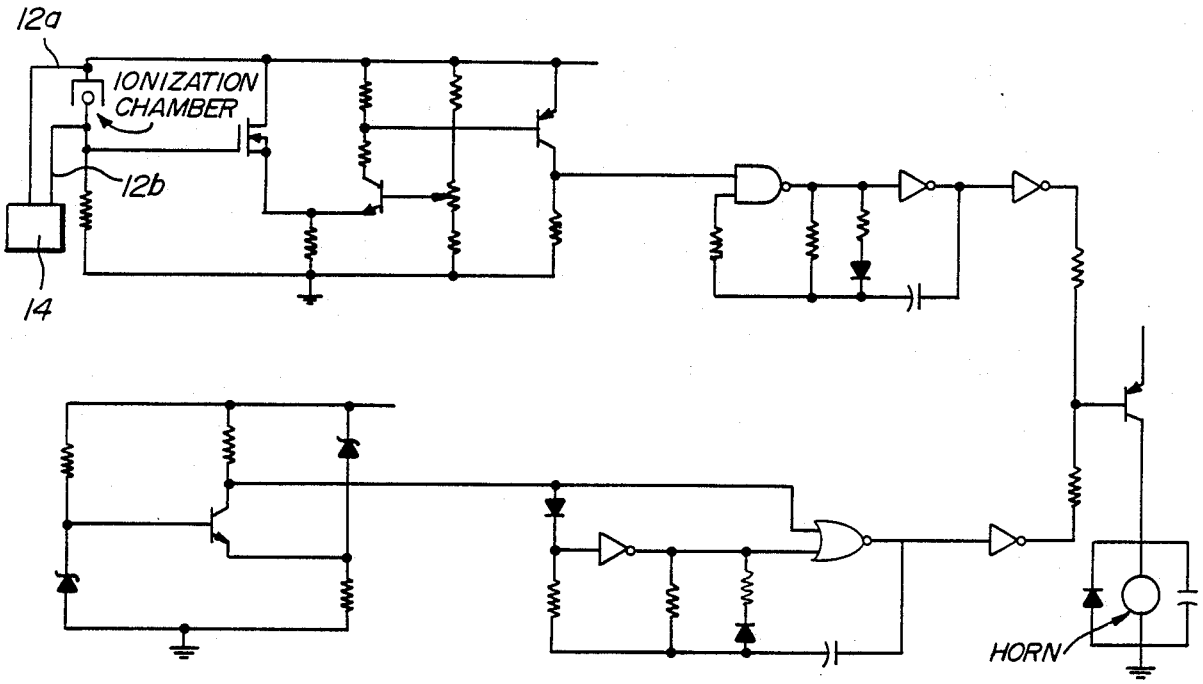
Figure 4C:
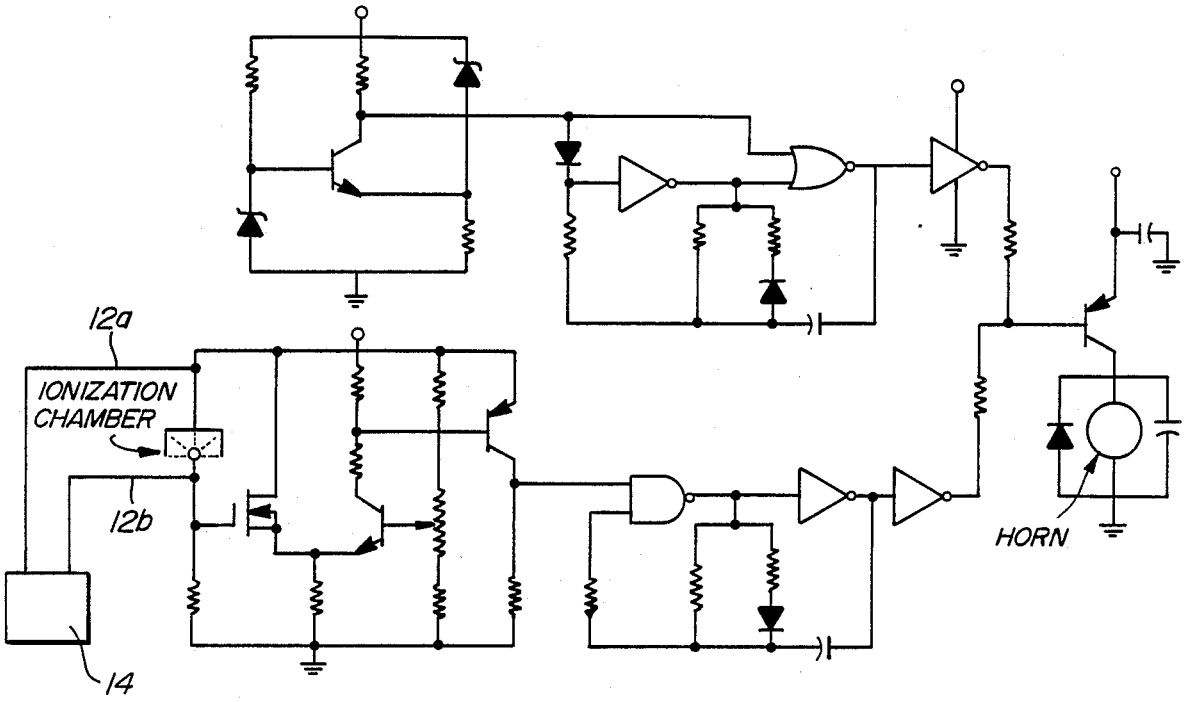

Leads 12*a*, 12*b* are connected to either side of an ionization chamber of a conventional smoke alarm circuit of the ionization type, as can be seen in FIGS. 4*a*, 4*b*, 4*c*. The smoke alarm circuits illustrated in FIGS. 4*a*, 4*b*, 4*c*, show three types of prior art smoke alarm circuitry. Such circuits are available in numerous publications, among them "The Modern Electronic Circuits Reference Manual," Chapter 29, which is incorporated by reference herein and from which source FIGS. 4*a*, 4*b*, 4*c* were derived. As can be seen in these circuit diagrams, sensor head 14 is connected via leads 12*a*, 12*b* to either side of the ionization chamber in parallel fashion. Hence, if electrical contact is made between electrodes 15*a*,15*b*, an electrical circuit will be completed and an alarm will be sounded. All of the illustrated circuits utilize an ionization chamber which normally exists in a condition of high impedance. When this relatively high impedance is lowered by smoke or gas, the circuitry associated therewith will cause an alarm signal to be sounded. For a more complete description of the manner of operation of the alarm circuitry in FIGS. 4*a*, 4*b*, 4*c* reference is made to the cited source material.

If the liquid level detector 13 of the herein invention is to be used as a sump pump alarm, it may be mounted in the fashion shown schematically in FIG. 1. The device, including smoke alarm 11 and line 12 attached thereto is mounted on the floor joist 12 and adjacent the exterior wall 24 of a basement, and above the sump pump 16 and sump well 18 thereof. If the leads 12*a*, 12*b* are connected to the smoke detector 11 in the manner shown in FIG. 2, it is contemplated that a bracket 34 will be used in conjunction therewith to provide a secure mounting of leads 12*a*, 12*b* to housing 30 of the smoke detector 11. Line 12 is then mounted on the discharge line 20 of the sump pump 16, by a variety of means such as brackets, adhesive tape, et cetera. The sensor head 14 of the combination smoke and water detector 10 is positioned so that it is immediately above the highest acceptable water level 19 consistent with efficient and correct operation of sump pump 16. Since electrode ends 15*a*, 15*b* will be above the normal water level 19, the electric circuit will remain uncompleted and no alarm will sound.

In the event of a sump pump failure, water level 19 will rise and will cause sensor head 14 to become immersed therein. The water will cause electrical contact to be made between exposed electrodes 15*a*, 15*b*, thereby completing the circuit and causing the alarm signal to be sounded.

It is contemplated that other designs of the sensor head 14 are conceivable for one skilled in the art without departing from the teachings of the herein invention. For example, exposed electrodes 15*a*, 15*b* may be made flush with jacket 40. However, problems may arise with this arrangement since varying conditions of temperature and humidity may, upon occasion, cause moisture to condense on sensor head 14, which condensation may run down sensor head 14 and cause electrical contact to be made between electrodes' 15*a*, 15*b*, thus causing a false alarm. It is also possible for electrodes 15*a*, 15*b* to project from or be flush with opposite faces of jacket 40, or to project from the end thereof or opposite sides thereof.

As can be seen in circuit diagram 4*b*, it is possible to connect a plurality of sensor heads 14 in parallel with the ionization chamber. By using a plurality of sensors 14, undesirable water levels may be detected in a plurality of locations. Thus, it would be possible to place the sensors in various locations in, for example, a basement, particularly in known low spots thereof. Thus, flooding caused by conditions other than sump pump failure may be detected, such as, for example, backed up sewer pipe, overflowing washing machines or laundry tubs, or drainage system failures caused by flash floods.

While the embodiment depicted shows the liquid level detector of the instant invention used as a sump pump alarm, there may be other situations where the liquid level detector claimed and disclosed herein may find application. Such uses might be, for example, to monitor the level of a liquid inside a closed tank. Other such applications may occur to one skilled in the art by using the teachings of the instant invention. Hence, the scope of the present invention is not limited by the embodiments and exemplifications described herein, but rather by the claims appended hereto.

I claim:

1. For use with a smoke alarm of the ionization type having an ionization chamber which acts in response to the pressure of a predetermined level of ionization therein to lower the impedance thereof and circuitry operatively associated therewith to cause an alarm signal to be sounded in response to said lowered impedance, a liquid level detector comprising:

a sensor head having two spaced apart electrodes, each in electrical communication with an electrically conductive lead, said leads being connected to either side of the ionization chamber so that the electrodes are in parallel therewith, whereby liquid in contact with the electrodes establishes a conductive path therebetween, thereby completing the alarm circuit and causing sounding of the alarm signal.

2. The detector of claim 1 wherein the ionization chamber is contained within an electrically conductive housing and the smoke alarm is provided with a test button connected to ground, depression of which causes the alarm signal to sound, one lead of the liquid level detector being in electrical contact with the housing and the other lead being in electrical contact with the test button.

3. The detector of claim 1 wherein the head further comprises a non-conductive, flexible jacket at lease partially enclosing said electrodes.

4. The detector of claim 3 wherein a pair of hollow projections are formed on a face of the jacket, a portion of one of said electrodes extending from each projection.

5. The detector of claim 1 wherein said head is disposed in a sump pump well located in a basement of a structure above a predefined water level thereof to serve as an indicator of sump pump failure.

6. The detector of claim 5 wherein the leads are mounted on a discharge line of the sump pump.

7. The detector of claim 1 further comprising a plurality of such heads and associated electrodes and leads, each pair of leads being connected to either side of the ionization chamber.

8. The detector of claim 6 wherein each of the plurality of leads is disposed in a different location in the vicinity of the detector.

9. The detector of claim 1 wherein the device functions as a combination smoke and liquid level alarm.

* * * * *